United States Patent [19]

Lambert

[11] 4,426,918

[45] Jan. 24, 1984

[54] PROPORTIONING AIR DIFFUSER AND SYSTEM

[76] Inventor: Robert R. Lambert, 442 W. Leadora, Glendora, Calif. 91740

[21] Appl. No.: 323,788

[22] Filed: Nov. 23, 1981

Related U.S. Application Data

[63] Continuation of Ser. No. 143,784, Apr. 25, 1980, abandoned.

[51] Int. Cl.[3] ..... F24F 13/10

[52] U.S. Cl. ..... 98/40 D; 98/41 SV

[58] Field of Search ..... 98/40 R, 40 C, 40 D, 98/40 N, 41 SV; 137/872, 874

[56] References Cited

U.S. PATENT DOCUMENTS

| | | | |
|---|---|---|---|
| 2,852,311 | 9/1958 | Alexeff | 98/40 N X |
| 3,223,019 | 12/1965 | Schuh | 98/40 D |
| 3,308,741 | 3/1967 | Chambers | 98/40 D |
| 3,601,033 | 8/1971 | Lambert | 98/40 D |
| 3,608,468 | 9/1971 | McClurkin | 98/40 C X |
| 3,780,503 | 12/1973 | Smith | 98/41 SV |
| 3,988,973 | 11/1976 | Hönmann | 98/40 C |
| 4,258,616 | 3/1981 | Zeller et al. | 98/40 D |

FOREIGN PATENT DOCUMENTS

| | | | |
|---|---|---|---|
| 525222 | 8/1940 | United Kingdom | 98/40 C |

*Primary Examiner*—William E. Wayner
*Assistant Examiner*—Harold Joyce
*Attorney, Agent, or Firm*—Poms, Smith, Lande & Rose

[57] ABSTRACT

A proportioning air diffuser system, and an air diffuser therefor, for venting air from a dynamic plenum having areas of relatively greater and lesser static pressure. Each diffuser has a plurality of selectively adjustable vent openings, and a corresponding plurality of air extractors extending into the plenum to divert air through the diffuser. The effective venting area is selectively adjustable, but only within limits that prevent the diffusers from being completely closed. The diffusers are distributed along the plenum, with their effective vent areas progressively increasing from plenum areas of greater to areas of lesser static pressure. The volumetric rate of air flow through the diffusers can thereby be balanced.

In a preferred embodiment, two plates having alignable vent openings are positioned over each other. One of the plates is slidable over the other, thereby functioning as a damper to control the alignment between plate vent openings, and thus the effective vent area. A stop depends from the slidable plate through a vent opening of the other plate to limit the sliding range, and provides an engagement point for an adjustment handle.

1 Claim, 7 Drawing Figures

PROPORTIONING AIR DIFFUSER AND SYSTEM

This is a continuation of application Ser. No. 143,784, filed Apr. 25, 1980, now abandoned.

BACKGROUND OF THE INVENTION

1. Field of the Invention

This invention relates to ventilation systems, and more particularly to systems in which a plurality of air diffusers are distributed along a duct which encloses a dynamic flow of air.

2. Description of the Prior Art

Suspended ceiling installations have been provided with air ducts which run across the ceiling. Air diffusers which vent air from the duct into the room below are distributed along the length of the duct, typically at spaced intervals. Either heating or cooling air is blown through the duct, thereby creating a dynamic plenum. Upstanding extractor vanes on each of the diffusers deflect a portion of the flowing air out of the duct and into the room. Such a suspended ceiling air distribution system is shown in my U.S. Pat. No. 3,577,904. An improvement on this system is described in my U.S. Pat. No. 3,601,033, in which the diffusers include vents along their sides to permit a return flow of air from the room into the ceiling external to the duct, and a blank-off ember which can be positioned to block the flow of air through the diffuser from the duct into the room. A certain degree of control over the distribution of treated air from the duct is thus attainable by a selective positioning of the blank-off members over particular diffusers.

While my U.S. Pat. No. 3,601,033 offers an improvement in the distribution of treated air, it is not optimal. The described air ducts may be characterized as enclosing dynamic plenums, i.e., plenums having a directional flow of air. Since the ducts are of finite length and are generally closed or restricted at the downstream end, a static pressure progressively builds up as the downstream end is approached. This static pressure causes the volumetric rate of air flow through the downstream diffusers to exceed the rate at which air is vented from the upstream diffusers, thus violating the situation in which air is ideal, vented through all the diffusers at the same rate. The resulting flow rate discrepancies can result in an uneven temperature distribution in the vented area. Aside from the discomfort of being in an area that is either too hot or too cold, the occupants of the building may take corrective action by blanking off one or more diffusers if a system such as that described in my U.S. Pat. No. 3,601,033 is used. Such action could further gravate the situation in areas where the diffusers have not been blanked off. The result is discomfort to the occupant, and an inefficient use of the energy expended to heat or cool the air flowing through the duct.

The construction of partitions or walls between the diffusers of a continuous duct is another situation in which the uneven venting of air in the prior art is a problem. Again, persons in rooms which receive either too much or too little treated air may become uncomfortable, and may blank off their individual diffusers and thereby worsen the problem in other rooms.

SUMMARY OF THE INVENTION

In view of the above problems associated with the prior art, it is an object of the present invention to provide an air diffuser system capable of uniformly venting air along the length of a dynamic plenum, despite variances in the static pressure along the plenum.

Another object of the invention is the provision of such a system, in which an occupant of the room has only a limited degree of freedom to adjust the venting arrangement.

Still another object is the provision of air diffuser units of uniform construction that can be distributed along a dynamic plenum, and are capable of being adjusted to compensate for the effects of non-uniform static pressures along the plenum.

These and other objects of the invention are realized by a proportioning air diffuser system in which a plurality of essentially similar air diffuser assemblies are distributed along a plenum. Each assembly includes a plurality of vent means for venting air from the plenum, a plurality of air extractor means extending from each of the vent means respectively into the plenum, and selectively adjustable damper means for adjusting the areas of the vents. Stop means are also provided to prevent the vent from being fully closed. The diffuser assemblies can be adjusted so that the diffusers at the areas of relatively greater static pressure have relatively lesser effective venting areas than do the diffusers at the areas of relatively lesser static pressure. The volumetric air venting rates of the various diffusers can thereby be balanced, and the ability of building occupants to unbalance the system is limited.

In a preferred embodiment, the diffusers each include first and second blocking plates slidably stacked over each other. Each of the plates includes a grid of vent openings. By sliding one plate over the other the alignment of the vent openings, and thus the effective vent area, can be varied within predetermined limits. A stop tab depends from one of the plates through an opening of the other plate to limit the adjustment range, and can be engaged by a vent adjustment handle to set the diffuser at the desired vent capacity.

These and other features and advantages of the invention will be apparent to those skilled in the art from the following detailed description of a preferred embodiment, read in conjunction with the appended drawings, in which:

DESCRIPTION OF A PREFERRED EMBODIMENT

Figure 1:
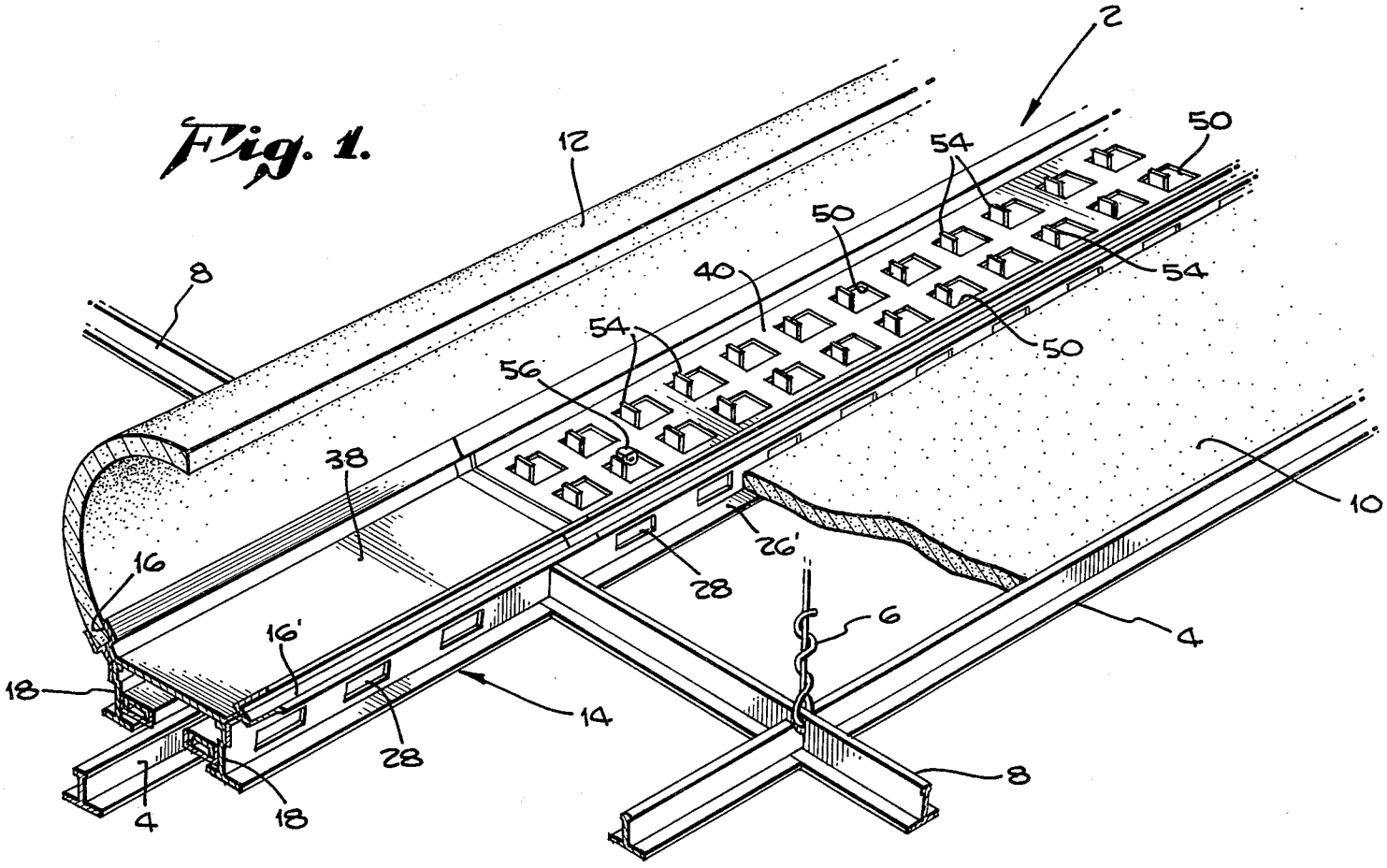
FIG. 1 is a cutaway perspective view of an afr diffuser constructed in accordance with the invention, mounted in a suspended ceiling air duct.
Figure 2:
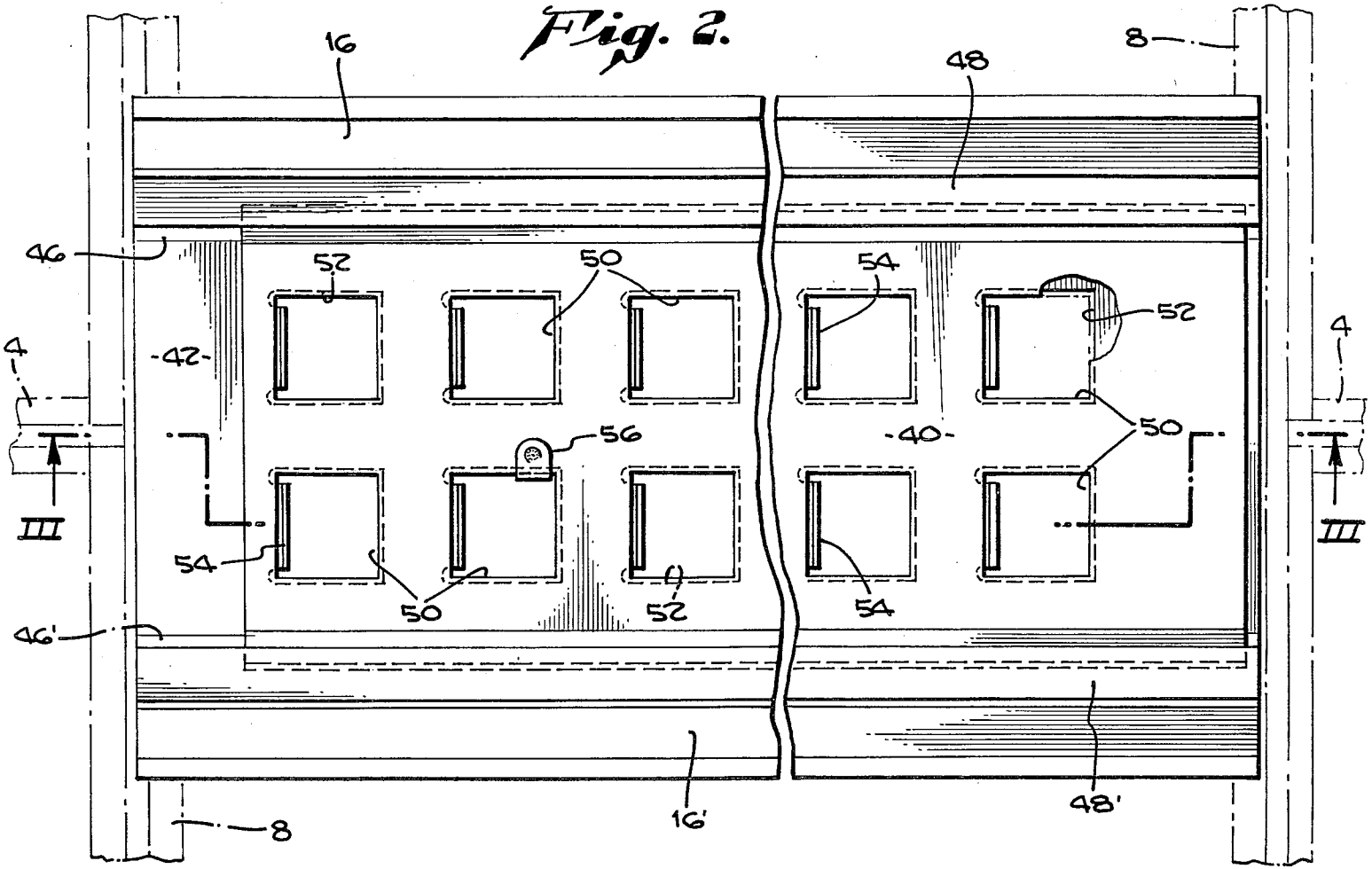
FIG. 2 is a top view of the diffuser mounted as in FIG. 1.

Referring first to FIG. 1, an air diffuser 2 constructed in accordance with the invention is shown situated in a suspended ceiling system of the type described my U.S. Pat. No. 3,577,904. Main inverted T-runners, indicated generally at 4, are suspended from the soffit or ceiling by conventional hanger wires 6. Cross inverted T-bars 8 span the distance between main runners 4, and are secured thereto in conventional manner to complete a grid system which normally supports acoustical or other ceiling tiles 10.

A duct 12 of conventional insulating material runs above the suspended ceiling to enclose a flow of treated air, which may be either heated or cooled. Diffusers 2 are distributed periodically along the length of the duct between cross bars 8. Air blocking assemblies 14 are provided between cross bars 8 where no ventilation is desired. Each of the diffusers 2 and air blocking assemblies 14 is provide with a pair of lengthwise upward and outward extending duct keeper channels 16 which receive respective lengthwise ends of duct 12, holding the diffusers and air blocking assemblies adjacent the duct so that air can be vented from the duct through the diffusers and into the room below.

Figure 3:
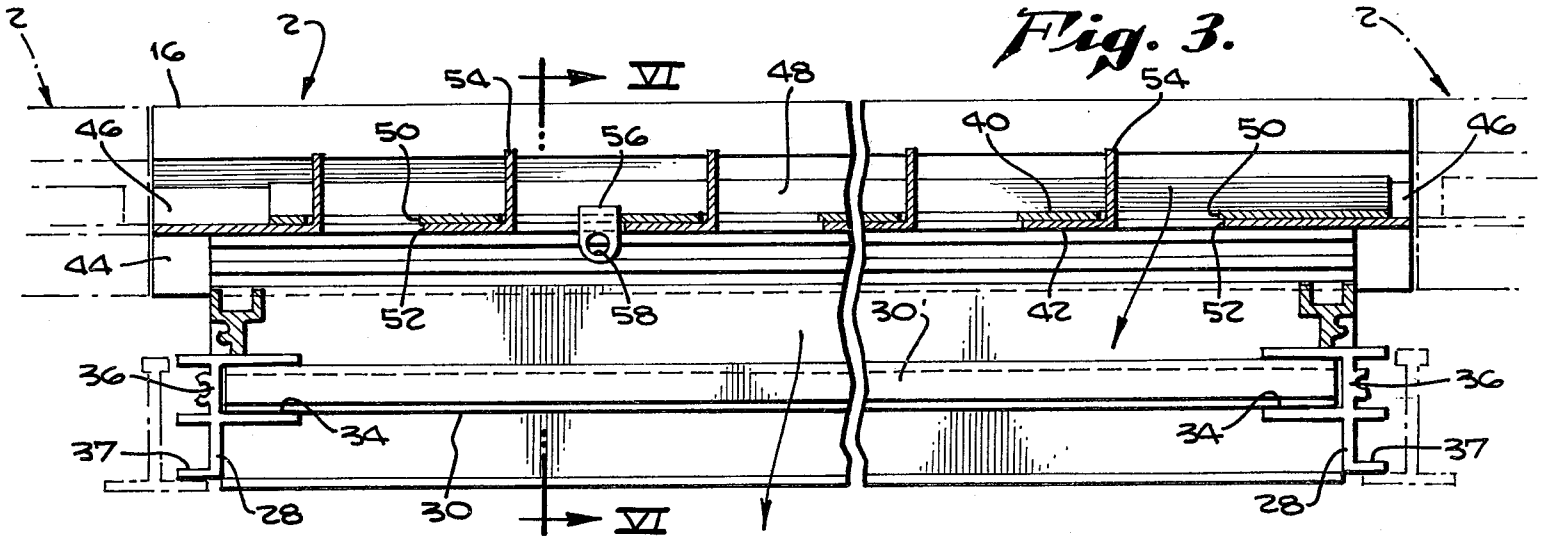
FIG. 3 is a cross-sectional view of the diffuser along the section line 3—3 of FIG. 2, with the diffuser almost fully open.
Figure 6:
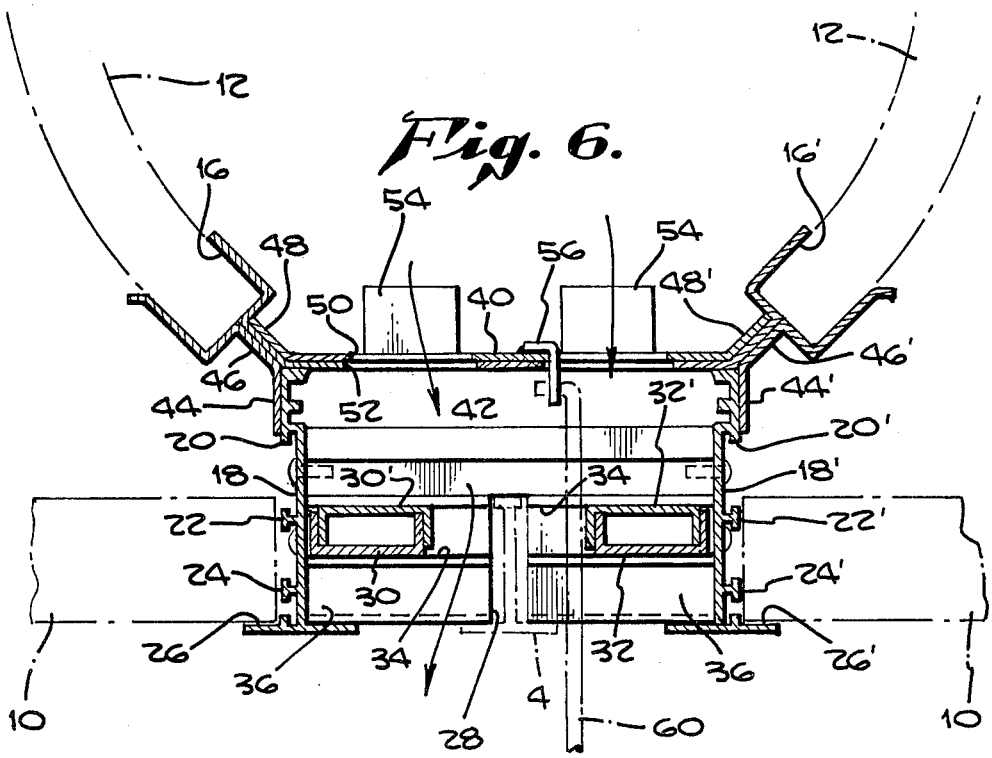
FIG. 6 is a sectional view of the mounted diffuser taken along the section lines 6—6 of FIG. 3.

The diffusers 2 and air blocking assemblies 14 are each divided into lower base portions and upper operating portions. A common base portion is used for both units, so that the ceiling can be assembled with the base portions in place and the operating portions added afterwards in any desired pattern. The base portion is best seen in FIGS. 1, 3 and 6. Each base portion has a pair of spaced sidewall members 18 and 18' having laterally extending upper flanges 20 and 20', mid flanges 22 and 22', lower flanges 24 and 24', and bottom tile-supporting flanges 26 and 26'. A plurality of slots 28 are formed in the sidewall members between opposed flanges 20 and 22, and 20' and 22'. Slots 28 provide a passageway for a return of air from the room to the space above the suspended ceiling. Blocking bars (not shown) can be slid between flanges 20 and 22, and 20' and 22' to block the flow of air through slots 28; this would be done when an air diffuser, as opposed to an air blocking assembly, is mounted over the base. The functioning of return slots 28 is more fully described in my U.S. Pat. No. 3,601,033.

Referring to FIG. 6, the ends of the base portions are slotted at 28 to straddle the vertical leg or web of the runners 4. Weir means in the form of exemplary nested U-shaped channel weir members 30, 30' and 32, 32', as more fully disclosed in my U.S. Pat. No. 3,411,425, are provided in the base assemblies between walls 18 and 18'. The ends of the weir members are slidably mounted in channel-like recesses 34 formed in end plates 36, as best seen in FIG. 3. End plates 36 are held between sidewalls 18 and 18' by conventional fastening means. The weir members 30, 32 and 30, 32' may be adjusted relative to one another to control the direction and amount of air distributed through the assemblies. The use of the weir members is not essential to the invention, however, and they may be omitted. Flanges 37 extend outwardly from the lower ends of end plates 36, and rest on the horizontal webs of T-bars 8.

The upper portion of air blocking assemblies 14 consists of a solid plate 38 (shown in FIG. 1) which fits over the base assembly to block the flow of air there through.

The upper operating portion of air diffusers 2, best seen in FIGS. 1, 2, 3, 6 and 7, consists of a pair of upper and lower blocking plates 40 and 42, respectively. Lower plate 42 has a pair of downward depending webs 44 and 44' along its lateral edges, which nest with upper flanges 20 and 20' of the base assembly to locate the plate laterally. Duct keeper channels 16 and 16' are carried at the ends of longitudinal webs 46 and 46' which extend diagonally outward from the lateral edges of plate 42. Upper plate 40 includes a pair of longitudinal webs 48 and 48' which extend diagonally outward from its lateral edges at the same angle, and for substantially the same distance as webs and 46 and 46'. Upper plate 40 is thus slid in place over lowerlate 42, and captured against upward movement by the contact of webs 48 and 48' with the outer walls of duct keeper channels 16 and 16'.

Plates 40 and 42 have a plurality of vent openings 50 and 52, respectively, stamped therein. Vent openigs 50 and 52 are of substantially equal size and are arranged in similar grid patterns along their respective plates, whereby upper plate 40 can be slid longitudinally over lower plate 42 to bring opening 50 into varying degrees of alignment with openings 52. A plurality of upright air extractor vanes 54 are carried adjacent each of the lower plate vent openings 52, respectively, and extend inwardly into duct 12. As is known in the art, extractors 54 serve to translate a dynamic flow of air through the duct plenum to an outward flow of air through vent openings 52 and into the room below. Extractors 54 are preferably integral with lower plate 42, and may be formed by stamping out only a portion of openings 54 and bending the remaining portion upward to form the extractor.

A stop tab 56 is affixed to the upper surface of upper plate 40 adjacent one of the vent openings 50, and is bent to depend downwardly through both upper plate opening 50 and aligned lower plate vent opening 52. Tab 56 includes a small hole 58 near its lower end whch can be engaged by an adjustment handle 60, shown in FIG. 6, to slide upper plate 40 back and forth over lower plate 42. Since tab 56 is attached to upper plate 40 but extends through a vent opening of lower plate 42, it cannot be moved beyond the boundaries of the lower plate opening, and thereby serves as a stop to limit the sliding movement of the upper plate.

Each of the plates 40 and 42 may be viewed as a grid pattern of webs 60 and 62 surrounding vent openis 50 and 52, respectively. Whenever upper plate 40 is slit to a position at which the webs of one plate partially occlude the vent openings of the other plate, the flow of ir from the plenum through the diffuser is restricted to the unoccluded portions of the vent openings. In this manner the effective venting area of the air diffuser, and thereby the volumetric flow rate of air through the diffuser, may be selectively adjusted by sliding upper plate 40 to a desired position over lower plate 42.

The width of webs 60 and 62 between vent openings 50 and 52 is preferably less than the width of the vent openings in the direction of slide. For example, the webs may be three-quarters inch wide, and the vent openings one and one-quarter inch wide between webs. With this arrangement, it is not possible for upper plate 40 to completely block off the flow of air through the diffuser, and a proportional flow of air through the diffusers along the duct cannot be completely defeated by a person who wishes to shut off one diffuser completely. While the relative spacing between the vent openings and the webs of each plate thus requires that at least some air always flow through the diffuser, the positioning of stop tab 56 on the opposite side of an upper plate vent opening 50 from extractor vane 54 on the corresponding lower plate vent opening 52, assures that the unblocked portion of opening 52 is always adjacent extractor 54.

The flow of air from the plenum in duct 12 through the air diffusers and into the room below is shown by the flow arrows in FIG. 6. After being deflected by an extractor 54, air flows through the aligned portions of vent openings 50 and 52, past the weir, and out into the room.

Figure 5:
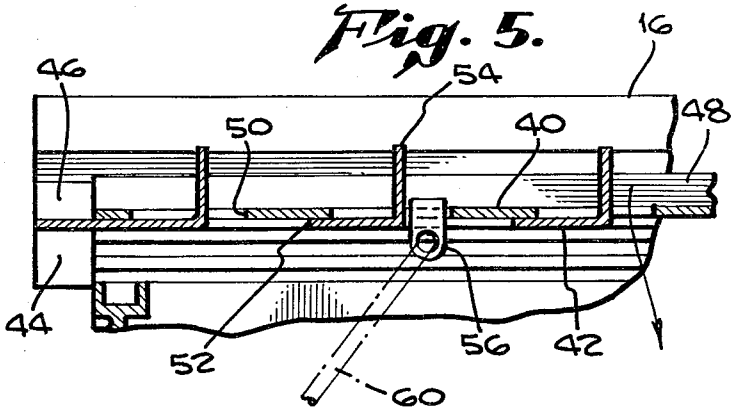
FIGS. 4 and 5 are fragmentary sectional views showing the vent adjustment mechanism for the diffuser in two different positions.
Figure 4:
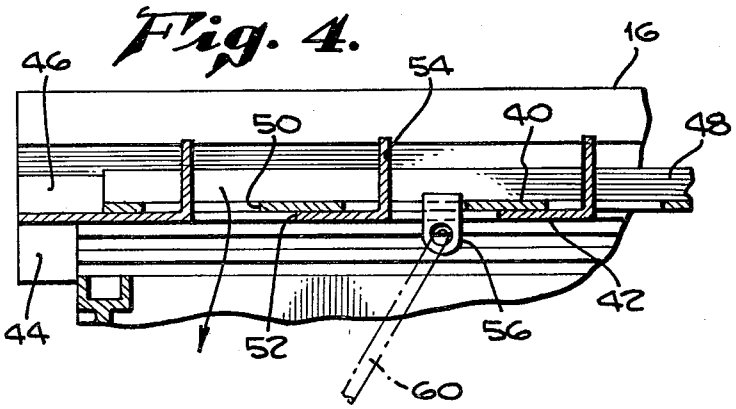
Figure 7:
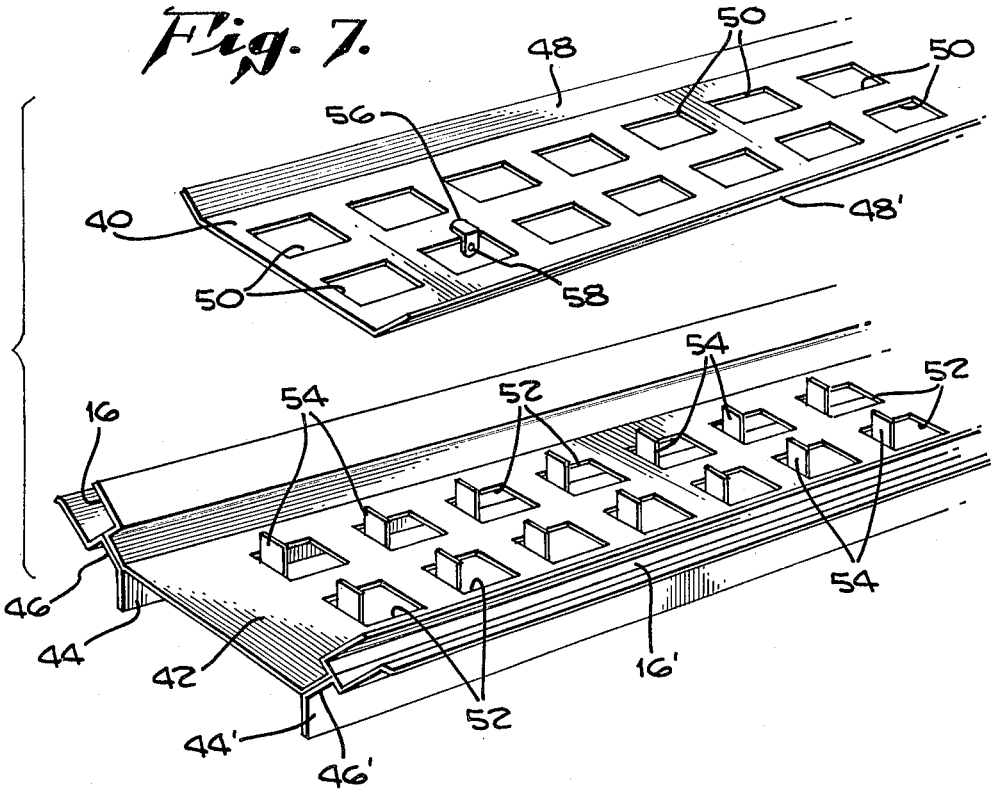
FIG. 7 is an exploded perspective view of the two plates forming a preferred embodiment of the diffuser.

The selective adjusment capability of the diffuser is illustrated in FIGS. 3–5. Referring first to FIG. 3, a diffuser is shown in an almost fully open position. Upper plate 40 is shown almost at the right hand limit of its sliding range, with stop tab 56 about to strike the wall of the lower vent opening 52 through which it extends. In this position, the upper and lower plate vent openings 50 and 52 are nearly aligned, permitting a near maximum flow of air through the diffuser. In FIG. 4, upper plate 40 has been slit approximately half-way to the left by pulling on handle 60 inserted through the opening in stop tab 5. In this position, the right hand portion of lower vent openings 52 are occluded by the web portions of upper plate 40, while the left hand portion of upper vent openings 50 are occluded by the lower plate webs. Accordingly, flowing air deflected by extractors 54 is free to flow only through the portions of upper and lower vent openings 50 and 52 that are in alignment. As a result, the effective venting area of the diffuser is reduced.

The diffuser is shown in a position of near minimum air flow in FIG. 5. Upper plate 40 has been slid further to the left until stop tab 56 is about to strike the left hand wall of the lower plate vent opening 52 through which it extends, said wall being provided by one face of an extractor 54. In this position the effective vent area is near minimum, most but not all of the upper and lower vent openings being occluded by the lower and upper plates, respectively. As stop tab 56 cannot be moved further to the left than the limit of the lower vent opening 52 through which it extends, defeat of a balanced venting system by completely closing off some of the ducts is thus prevented. Upper plate 40 thus functions as a damper in controlling the effective venting area of the diffuser.

With a plurality of diffusers distributed along a duct, the upstream diffuser is adjusted by a technician to a position of maximum venting area. The effective venting areas of the downstream diffusers are progressively decreased by sliding their upper plates 40 to positions progressively occluding the lower plate vent openings. The effective venting area of each diffuser can thus be selectively adjusted to be inversely proportional to the static pressure within the duct at its location. With this arrangement, the volumetric flow rates from the treated air plenum through the diffusers are substantially balanced along the length of the entire duct, resulting in more efficient use of the energy expended to treat the air within the duct, and in a more uniform heating or cooling level for occupants of the building.

While a particular embodiment of the invention has thus been shown and described, numerous modifications and variations thereof are possible. Accordingly, it is intended that the invention be limited only in terms of the appended claims.

I claim:

1. An air diffuser assembly for venting air from a dynamic plenum to an area to be vented, having: a pair of upper and lower blocking plates having substantially similar patterns of vent openings each of said plates comprising a grid of alternating webs and vent openings of approximately equal size with the vent openings defined between the webs, a plurality of upstanding air extractor vane means carried adjacent the vent openings on the plenum side of the lower plate of said plates and extending upwardly through vent openings of the upper plate of said plates, means for mounting said plates in overlapping alignment with said upper plate adjacent the plenum and said lower plate adjacent the vented area, said upper plate being slidable over the lower plate to vary the alignment between the vent openings of each plate, the aligned portions of the vent openings of the two plates defining the effective vent between the plenum and the vented area, means for sliding the upper plate over the lower plate to vary the size of said effective vent, the webs of the upper plate progressively masking the vent openings of said lower plate as the upper plate is moved to a position of minimum effective venting; the improvement comprising:

the dimension of the venting openings for the lower plate in the direction of slide of said upper plate over said lower plate being slightly greater than the dimension of the webs of the upper plate of said plates in the same direction, whereby said air diffuser assembly function as a diffuser through the effective vent cannot be defeated, and means for limiting the sliding movement of said upper plate relative said lower plate.

* * * * *